US006358913B1

(12) United States Patent
Schaumann et al.

(10) Patent No.: US 6,358,913 B1
(45) **Date of Patent: *Mar. 19, 2002**

(54) USE OF SELECTED POLYDIORGANOSILOXANES IN FABRIC SOFTENER COMPOSITIONS

(75) Inventors: Monika Schaumann, Overath; Jürgen Kaschig, Freiburg, both of (DE); Caroline Schäfer; Frank Lee, both of Riehen (CH); Erich Rössler, Stadtbergen (DE); Harald Chrobaczek, Augsburg (DE); Dieter Walz, Neusäss (DE)

(73) Assignee: Ciba Specialty Chemicals Corporation, Tarrytown, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/403,990

(22) PCT Filed: Apr. 21, 1998

(86) PCT No.: PCT/EP98/02337

§ 371 Date: Oct. 29, 1999

§ 102(e) Date: Oct. 29, 1999

(87) PCT Pub. No.: WO95/24460

PCT Pub. Date: Sep. 14, 1995

(30) Foreign Application Priority Data

May 1, 1997 (EP) ..... 97810272

(51) Int. Cl.[7] ..... C11D 1/62; C11D 3/37
(52) U.S. Cl. ..... 510/515; 510/466
(58) Field of Search ..... 510/466, 515

(56) References Cited

U.S. PATENT DOCUMENTS 4,767,547 A 8/1988 Straathof et al. ..... 252/8.8
4,818,421 A 4/1989 Boris et al.
4,840,738 A * 6/1989 Hardy et al. ..... 252/8.6
5,066,414 A * 11/1991 Chang ..... 252/8.8
5,207,933 A * 5/1993 Trinh et al. ..... 252/8.6

FOREIGN PATENT DOCUMENTS

| | | |
|---|---|---|
| EP | 0133562 | 2/1985 |
| EP | 0255711 | 2/1988 |
| EP | 0370675 | 5/1990 |
| EP | 0544493 | 6/1993 |
| EP | 0869168 | 10/1998 |
| WO | 95/24460 | 9/1995 |
| WO | 97/31998 | 9/1997 |

OTHER PUBLICATIONS

Abstract for EP 0133562

* cited by examiner

*Primary Examiner*—John Hardee
(74) *Attorney, Agent, or Firm*—Kevin T. Mansfield

(57) ABSTRACT

The invention relates to the use of fabric softener compositions comprising: (a) as active substance, a quaternary ammonium compound of formula (1), in which R is the aliphatic radical of tallow fatty acid, in particular a mono- or polyunsaturated aliphatic $C_{17}$ radical; and (b) is a nitrogen-free polydiorganosiloxane having terminal silicon-bonded hydroxyl groups; for the treatment of textile fibre materials. The fabric softener compositions impart a soft handle to the treated textile and are readily biodegradable. The fibre materials treated with the novel fabric softener compositions are very particularly characterized by good rewettability (1)

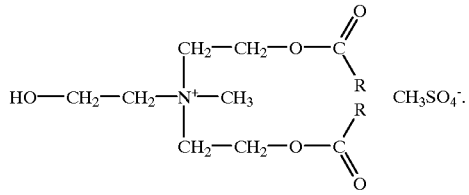

14 Claims, No Drawings

USE OF SELECTED POLYDIORGANOSILOXANES IN FABRIC SOFTENER COMPOSITIONS

The present invention relates to the use of selected polydiorganosiloxanes in fabric softener compositions and to fabric softener compositions comprising these polydiorganosiloxanes.

Fabric softener compositions which can be added to the rinse water when washing household laundry are well known as "softeners". Such compositions normally comprise, as active substance, a water-insoluble quaternary ammonium compound. Commercially available fabric softener compositions are based on aqueous dispersions of water-insoluble quaternary compounds. In recent times, there has been increasing interest in biodegradable active substances. Such compounds are, for example, esters of quaternary ammonium compounds, so-called "esterquats", which have at least one long-chain hydrophobic alkyl or alkenyl group interrupted by carboxyl groups. Such compounds are described, for example, in EP-A-0 239 910 or WO 95/24460.

Particularly suitable esters of quaternary ammonium compounds correspond to the formula (1)

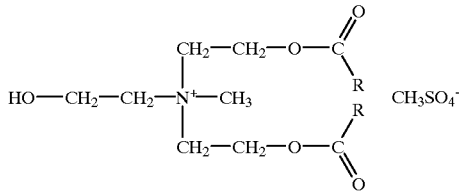

in which

R is the aliphatic radical of tallow fatty acid, in particular a mono- or polyunsaturated aliphatic $C_{17}$ radical.

Active substances in fabric softener compositions which impart a good soft handle to the treated textile have the disadvantage that they lower the water absorbency of the textile fabric, in particular cotton fabric treated with the fabric softener In particular, this disadvantage of low rewettability is highly pronounced in the case of the aforementioned esterquats.

The object of the present invention is thus to find an additive for fabric softener compositions which improves the rewettability of the treated textiles and which at the same time does not impair the other positive properties, such as soft handle and static properties of the treated items.

Surprisingly, it has been found that certain polysiloxanes satisfy these prerequisites.

The present invention thus provides for the use of fabric softener compositions comprising (a) as active substance, a quaternary ammonium compound of the formula (1); and (b) a nitrogen-free polydiorganosiloxane having terminal silicon-bonded hydroxyl groups; for the treatment of textile fibre materials.

The polydiorganosiloxanes are linear or practically linear siloxane polymers having terminal silicon-bonded hydroxyl radicals. Polydiorganosiloxanes of this type have about 2, in particular from about 1.9 to 2, organic radicals per silicon atom, and can be prepared by known processes.

The novel polydiorganosiloxanes have an average molecular weight of at least 750, at least 50% of the organic substituents in the diorganopolysiloxane being methyl radicals and all of the other organic substituents present being monovalent hydrocarbons having from 2 to 30 carbon atoms.

Examples of suitable monovalent hydrocarbon radicals having from 2 to 30 carbon atoms are alkyl or cycloalkyl radicals, such as ethyl, propyl, butyl, n-octyl, tetradecyl, octadecyl or cyclohexyl, alkenyl radicals, such as vinyl or allyl, and aryl or aralkyl radicals, such as phenyl or tolyl.

The polydiorganosiloxanes preferably have a molecular weight of from 20,000 to 90,000.

Preferred polydiorganosiloxanes are polydimethylsiloxanes which correspond to the formula (2)

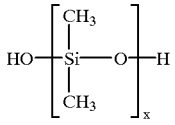

in which x is from 300 to 1000, preferably from 400 to 800.

The average number of hydroxyl groups per silicon atom can be determined in the following way: $^{29}$Si-NMR spectroscopy is used to determine the ratio of the number of silicon atoms to which the hydroxyl groups are bonded, in some cases via alkylene bridges, to the number of silicon atoms to which no OH groups or radicals containing OH groups are bonded.

Suitable compounds are described, for example, in DE-B-2 459 936.

In the preparation of fabric softeners the polydiorganosiloxanes used according to the invention are preferably used in the form of aqueous emulsions. These emulsions can be prepared as follows: the polydiorganosiloxane is emulsified in water using one or more dispersants and shear forces, e.g. by means of a colloid mill. Suitable dispersants are known to the person skilled in the art, e.g. ethoxylated alcohols or polyvinyl alcohol can be used. The dispersant(s) is/are used in customary amounts known to the person skilled in the art and can be added either to the polysiloxane or to the water prior to emulsification. Where appropriate, the emulsification operation can, or in some cases, must be carried out at elevated temperature. If desired, the polydiorganosiloxane dispersions may additionally comprise dispersed polyalkylene waxes. Examples of suitable polyalkylene waxes are oxidized polyethylene waxes.

Dispersions which comprise polysiloxane and such a wax are prepared by making a dispersion of a polysiloxane by the method described above and then combining it with a dispersion of an oxidized polyethylene wax which has been prepared separately. Suitable wax dispersions are available on the market.

A polysiloxane dispersion used according to the present invention for example has the following composition:

1 to 60, preferably 5 to 25% b.w. of α,ω-dihydroxydimethylpolysiloxane, 0 to 20, preferably 5 to 15% b.w. of polyethylene wax, 0.5 to 15, preferably 1 to 10.0% b.w. of fatty alcohol ethoxylate ($C_{16}$–$C_{18}$, saturated), 0 to 5, preferably 0.1 to 2.0% b.w. of stearylamine octaethoxylate, and water ad 100%.

Examples of suitable textile fibre materials which can be treated with the novel fabric softener composition are materials made of silk, wool, polyamide or polyurethanes, and, in particular, cellulosic fibre materials of all types. Such fibre materials are, for example, natural cellulose fibres, such as cotton, linen, jute and hemp, and regenerated cellulose. Preference is given to textile fibre materials made of cotton. The novel fabric softener compositions are also suitable for hydroxyl-containing fibres which are present in mixed fabrics, for example mixtures of cotton with polyester fibres or polyamide fibres.

The invention further provides a fabric softener composition comprising (a) a quaternary ammonium compound of the formula (1)

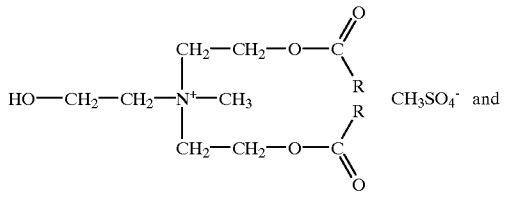

$CH_3SO_4^-$ and (b) a nitrogenfree polydiorganosiloxane having terminal silicon-bonded hydroxyl groups, in which R is the aliphatic radical of tallow fatty acid, in particular a mono- or polyunsaturated aliphatic $C_{17}$ radical.

Component b in the novel fabric softener composition is preferably a polydiorganosiloxane of the formula (2)

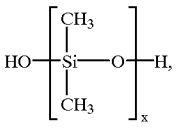

in which x is from 300 to 1 000.

The fabric softener composition preferably comprises from 1 to 20% b.w., preferably from 5 to 20% b.w., of component (a) and from 0. 1 to 20% b.w., preferably from 0.5 to 10% b.w., of component (b).

The novel fabric softener composition may also comprise additives which are customary for standard commercial fabric softeners, for example alcohols, such as ethanol, n-propanol, i-propanol, polyhydric alcohols, for example glycerol and propylene glycol; amphoteric and nonionic surfactants, for example carboxyl derivatives of imidazole, oxethylated fatty alcohols, hydrogenated and ethoxylated castor oil, alkyl polyglycosides, for example decyl polyglucose and dodecylpolyglucose, fatty alcohols, fatty acid esters, fatty acids, ethoxylated fatty acid glycerides or fatty acid partial glycerides; also inorganic or organic salts, for example water-soluble potassium, sodium or magnesium salts, non-aqueous solvents, pH buffers, perfumes, dyes, hydrotropic agents, antifoams, antiredeposition agents, polymeric or other thickeners, enzymes, optical brighteners, antishrink agents, stain removers, germicides, fungicides, antioxidants, corrosion inhibitors and anticrease agents.

The fabric softener composition according to the invention is usually prepared by firstly stirring the active substance, i.e. the quaternary ammonium compound of the formula (1), in the molten state into water, then, where required, adding further desired additives and, finally, after cooling, adding the polydiorganosiloxane emulsion.

The fabric softener compositions according to the invention impart a soft handle to the treated textile and are readily biodegradable. The fibre materials treated with the novel fabric softener composition are very particularly characterized by good rewettability.

The following examples serve to illustrate the invention without limiting it thereto.

EXAMPLE 1

Preparation of the Fabric Softener Composition According to the Invention

The compositions given in Table 1 are prepared as follows:

80% of the water is heated to 60° C. The molten esterquat is added with stirring and the mixture is stirred for 30 minutes. Heating is then stopped. The remaining water is mixed with the salt and added to the mixture in two steps with stirring. The mixture is stirred for 30 minutes, after which it is cooled with further stirring. The perfume oil is added at a temperature of <30° C. Finally, the polydimethylsiloxane emulsion is added.

TABLE 1

| Composition [% b.w.] | a | b | c | d | e | f |
|---|---|---|---|---|---|---|
| Esterquat of the compound of the formula (1) | 16.2 | 16.2 | 16.2 | 16.2 | 16.2 | 16.2 |
| $MgCl_2 \cdot 6\ H_2O$ | 0.3 | 0.3 | 0.3 | 0.3 | 0.3 | 0 |
| Perfume oil | 0.55 | 0.55 | 0.55 | 0.55 | 0.55 | 0 |
| Polydimethylsiloxane emulsion | 0 | 1 | 3 | 5 | 7 | 1.2 |
| Water, deionized | Rest | Rest | Rest | Rest | Rest | Rest |

The polydimethylsiloxane emulsion has the following approximate composition:

12.5% b.w. of α,ω-dihydroxydimethylpolysiloxane, 12.5% b.w. of polyethylene wax, 1.0% b.w. of fatty alcohol ethoxylate ($C_{16}$–$C_{18}$, saturated), 1.0% b.w. of stearylamine octaethoxylate, and 73.0% b.w. of water.

EXAMPLE 2

Absorptivity Test According to DIN 53924

Molton and Krefeld control fabric, 40×40 cm, are treated in a Wacker apparatus (description of the apparatus in K. Br äuer, H. Fehr, R. Puchta, Tens. Dct. 17, 281 (1980)) in cold water at a liquor ratio of 5:1 (5 parts b.w. of finishing liquor to 1 part b.w. of dry laundry) for 5 minutes. The concentration of the fabric softener compositions (a) to (f) is chosen so that 30 g of fabric softener are used per kg of dry laundry. Following the treatment, the textile is removed, spun for 15 seconds and hung up to dry.

The compositions are tested for absorptivity according to DIN 53924. This standard determines the rate of absorption, i.e. the rate at which water is transported into textile surface structures as a result of capillary forces. Only the rate of water transportation against the force of gravity is determined. The parameter measured is the increase in height [mm] over the course of various time intervals.

The test results are given in Table 2:

TABLE 2

| Determination of the absorptivity Height increase in mm | Composition | | | | | |
|---|---|---|---|---|---|---|
| | (a) | (b) | (c) | (d) | (e) | (f) |
| Krefeld control fabric | | | | | | |
| after 1 minute | 7 | 15 | 18 | 18 | 19 | 16 |
| 3 minutes | 15 | 27 | 32 | 33 | 33 | 26 |
| 5 minutes | 18 | 35 | 42 | 41 | 44 | 36 |
| 10 minutes | 27 | 47 | 57 | 57 | 59 | 49 |
| Molleton | | | | | | |
| after 1 minute | 22 | 23 | 33 | 40 | 37 | 25 |
| 3 minutes | 41 | 47 | 54 | 61 | 60 | 49 |
| 5 minutes | 51 | 61 | 68 | 74 | 75 | 62 |
| 10 minutes | 66 | 82 | 90 | 92 | 95 | 84 |

The results given in the table show that the absorptivity of the treated textiles can be significantly increased by the addition of the polydimethylsiloxane emulsion.

What is claimed is:

1. A method for the treatment of a textile fibre material, which comprises treating said material with a fabric softener composition comprising (a) as active substance, a quaternary ammonium compound of the formula (1)

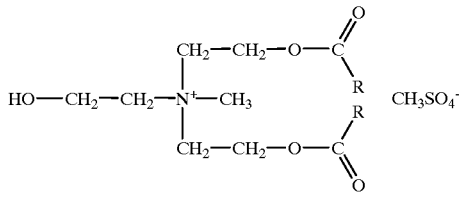

in which

R is the aliphatic radical of tallow fatty acid and (b) a nitrogen-free polydiorganosiloxane having terminal silicon-bonded hydroxyl groups, wherein the polydiorganosiloxane is used as an aqueous emulsion.

2. A method according to claim 1, wherein component (b) is a polydiorganosiloxane having a molecular weight of at least 750, at least 50% of the organic substituents in the polydiorganosiloxane being methyl radicals and all of the other organic substituents present being monovalent hydrocarbons having from 2 to 30 carbon atoms.

3. A method according to either claim 1, wherein the polydiorganosiloxane has a molecular weight of from 20,000 to 90,000.

4. A method according to claim 1, wherein component (a) is a mono- or polyunsaturated aliphatic $C_{17}$ radical.

5. A method according to any of claim 1, wherein the textile fibre material used is cotton.

6. A method according to claim 1, wherein the polydiorganosiloxane corresponds to the formula (2)

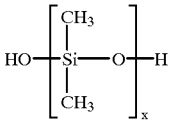

in which x is from 300 to 1000.

7. A method according to claim 6, wherein x is from 400 to 800.

8. A fabric softener composition comprising (a) a quaternary ammonium compound of the formula (1)

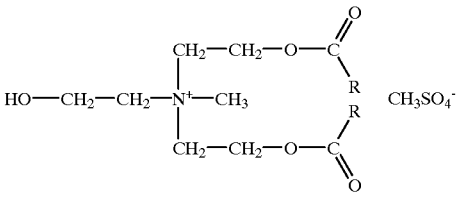

R is the aliphatic radical of tallow fatty acid and (b) a nitrogen-free polydiorganosiloxane having terminal silicon-bonded hydroxyl groups, wherein the polydiorganosiloxane is in the form of an aqueous emulsion.

9. A fabric softener composition according to claim 8, wherein component (a) is a mono- or polyunsaturated aliphatic-$C_{17}$ fatty acid radical.

10. A fabric softener composition according to claim 8, which comprises a polydiorganosiloxane of the formula (2)

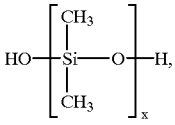

in which x is from 300 to 1000.

11. A fabric softener composition according to claim 10, wherein x is from 400 to 800.

12. A fabric softener composition according to claim 8, which comprises from 1 to 20% by weight component (a) and from 0.1 to 20% by weight of component (b).

13. A fabric softener composition according to claim 12, which comprises from 5 to 20% by weight of component (a).

14. A fabric softener composition according to claim 12, which comprises from 0.05 to 10% by weight of component (b).

* * * * *